US011404785B2

(12) United States Patent
Duan et al.

(10) Patent No.: US 11,404,785 B2
(45) Date of Patent: Aug. 2, 2022

(54) ANTENNA MODULE AND USER EQUIPMENT

(71) Applicant: BEIJING XIAOMI MOBILE SOFTWARE CO., LTD., Beijing (CN)

(72) Inventors: Xiaochao Duan, Beijing (CN); Lupeng Zhang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 17/147,391

(22) Filed: Jan. 12, 2021

(65) Prior Publication Data

US 2021/0359412 A1 Nov. 18, 2021

(30) Foreign Application Priority Data

May 13, 2020 (CN) ..... 202010401671.4

(51) Int. Cl.

| | |
|---|---|
| ***H01Q 5/35*** | (2015.01) |
| ***H01Q 11/14*** | (2006.01) |
| ***H01Q 21/00*** | (2006.01) |
| ***H01Q 5/40*** | (2015.01) |

(52) U.S. Cl.

CPC ..... *H01Q 5/35* (2015.01); *H01Q 5/40* (2015.01); *H01Q 11/14* (2013.01); *H01Q 21/0087* (2013.01)

(58) Field of Classification Search

CPC ..... H01Q 5/35; H01Q 5/40

See application file for complete search history.

(56) References Cited

U.S. PATENT DOCUMENTS

| | | | | |
|---|---|---|---|---|
| 6,181,281 | B1 * | 1/2001 | Desclos | H01Q 1/38 343/700 MS |
| 7,619,574 | B1 * | 11/2009 | West | H01Q 1/286 343/700 MS |
| 10,498,047 | B1 * | 12/2019 | McGough | H01Q 9/36 |
| 10,727,589 | B2 * | 7/2020 | Ikeda | H01Q 5/328 |
| 10,950,945 | B2 * | 3/2021 | Onaka | H01Q 13/08 |
| 2005/0179596 | A1 * | 8/2005 | Higasa | H01Q 9/0464 343/700 MS |
| 2009/0153404 | A1 * | 6/2009 | Ryou | H01Q 5/378 343/700 MS |
| 2010/0109846 | A1 * | 5/2010 | Nagai | H01Q 3/24 340/10.1 |

(Continued)

FOREIGN PATENT DOCUMENTS

EP 3641279 A1 4/2020

OTHER PUBLICATIONS

Extended European Search Report in the European Application No. 20216164.2, dated Jun. 2, 2021, (10p).

*Primary Examiner* — Ab Salam Alkassim, Jr.
(74) *Attorney, Agent, or Firm* — Arch & Lake LLP

(57) ABSTRACT

The antenna module includes: a first radiator having an opening; a second radiator located inside the opening, the second radiator being spaced apart from the first radiator; a first feed point located on the first radiator, the first feed point being configured for transmitting a wireless signal in a first frequency band; and a second feed point located on the second radiator, the second feed point being configured for transmitting a wireless signal in a second frequency band. The second frequency band differs from the first frequency band.

10 Claims, 9 Drawing Sheets

(56) References Cited

U.S. PATENT DOCUMENTS

| | | | | |
|---|---|---|---|---|
| 2010/0194663 | A1* | 8/2010 | Rothwell | H01Q 9/0407 343/876 |
| 2011/0254740 | A1* | 10/2011 | Maeda | H01Q 9/0407 343/700 MS |
| 2016/0351996 | A1* | 12/2016 | Ou | H01Q 21/065 |
| 2017/0346159 | A1* | 11/2017 | Xue | H01Q 5/314 |
| 2018/0159212 | A1* | 6/2018 | Wu | H04B 1/0064 |
| 2018/0277929 | A1* | 9/2018 | Seo | H01Q 5/20 |
| 2019/0036220 | A1* | 1/2019 | Paulotto | H01Q 9/0407 |
| 2019/0044218 | A1* | 2/2019 | Ye | H01Q 5/385 |
| 2019/0260127 | A1* | 8/2019 | Shi | H01Q 5/371 |
| 2020/0212544 | A1* | 7/2020 | Kwon | H04M 1/0262 |
| 2021/0126372 | A1* | 4/2021 | Duan | H01Q 9/0457 |
| 2021/0203072 | A1* | 7/2021 | Wu | H01Q 5/335 |
| 2021/0359394 | A1* | 11/2021 | Wang | H01Q 1/243 |

* cited by examiner

ANTENNA MODULE AND USER EQUIPMENT

CROSS-REFERENCE TO RELATED APPLICATIONS

This application is based on, and claims the benefit of priority to, Chinese Application No. 202010401671.4 filed on May 13, 2020. Disclosure of the Chinese Application is hereby incorporated by reference in its entirety for all purposes.

BACKGROUND

With rapid development of communication technology and technological demands, UE has entered an era of 5th Generation mobile communication technology (5G). At present, Non-Stand Alone (NSA) is a major application in the early stage of 5G development. An antenna module of UE may have to support a frequency band such as N78, N79, N41, etc. Therefore, UE may have to accommodate an antenna module for receiving and transmitting a 5G signal. However, addition of layout space on UE increasingly conflicts with a demand for UE of small clearance, a high screen ratio, etc. An antenna module may take up substantial space of UE.

SUMMARY

The subject disclosure relates to the field of communication. Embodiments herein provide an antenna module and UE.

According to a first aspect herein, an antenna module includes a first radiator, a second radiator, a first feed point, and a second feed point.

The first radiator has an opening.

The second radiator is located inside the opening. The second radiator is spaced apart from the first radiator.

The first feed point is located on the first radiator. The first feed point is configured for transmitting a wireless signal in a first frequency band.

The second feed point is located on the second radiator. The second feed point is configured for transmitting a wireless signal in a second frequency band.

The second frequency band differs from the first frequency band.

According to a second aspect herein, User Equipment (UE) includes a housing and an aforementioned antenna module.

The antenna module may be located inside the housing. The antenna module may be adapted to receiving and/or transmitting wireless signals of different frequency bands.

The above general description and detailed description below are but exemplary and explanatory, and do not limit the subject disclosure.

BRIEF DESCRIPTION OF THE ACCOMPANYING DRAWINGS

Drawings here are incorporated in and constitute part of the subject disclosure, illustrate embodiments according to the subject disclosure, and together with the subject disclosure, serve to explain the principle of the subject disclosure.

DETAILED DESCRIPTION

Figure 1:
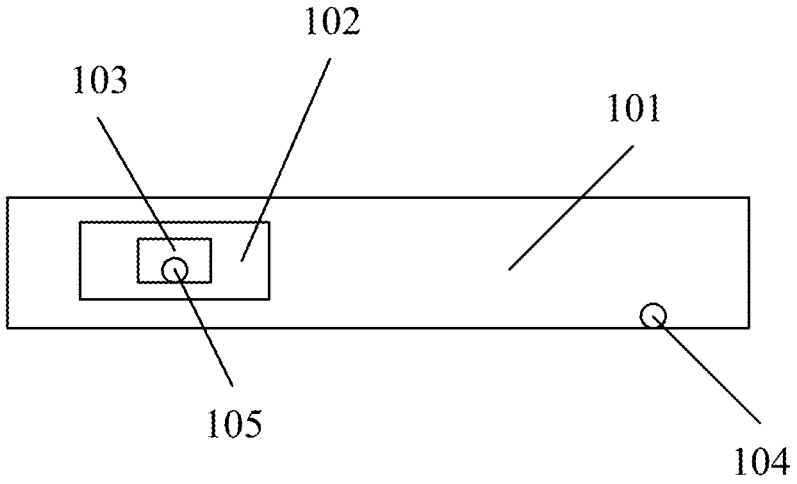
FIG. 1 is a diagram of an antenna module according to an example.

Exemplary embodiments (examples of which are illustrated in the accompanying drawings) are elaborated below. The following description refers to the accompanying drawings, in which identical or similar elements in two drawings are denoted by identical reference numerals unless indicated otherwise. Implementations set forth in the following examples do not represent all implementations in accordance with the subject disclosure. Rather, they are mere examples of the apparatus (i.e., device/equipment/terminal) and or method in accordance with certain aspects of the subject disclosure as recited in the accompanying claims.

The exemplary implementation modes may take on multiple forms, and should not be taken as being limited to examples illustrated herein. Instead, by providing such implementation modes, embodiments herein may become more comprehensive and complete, and comprehensive concept of the exemplary implementation modes may be delivered to those skilled in the art. Implementations set forth in the following examples do not represent all implementations in accordance with the subject disclosure. Rather, they are merely examples of the apparatus and or method in accordance with certain aspects herein as recited in the accompanying claims.

Terms used in the subject disclosure are for describing specific embodiments instead of limiting the subject disclosure. Singulars "a/an", "said" and "the" used in the subject disclosure and the appended claims are intended to include the plural form, unless expressly illustrated otherwise by context. The term "and/or" used in the subject disclosure refers to and includes any or all possible combinations of one or more associated items listed.

Note that although a term such as first, second, third may be adopted in an embodiment herein to describe various kinds of information, such information should not be limited to such a term. Such a term is merely for distinguishing information of the same type. For example, without departing from the scope of the embodiments herein, the first information may also be referred to as the second information. Similarly, the second information may also be referred to as the first information. Depending on the context, a term "if" as used herein may be interpreted as "when" or "while" or "in response to determining that".

In addition, described characteristics, structures or features may be combined in one or more implementation modes in any proper manner. In the following descriptions, many details are provided to allow a full understanding of embodiments herein. However, those skilled in the art will know that the technical solutions of embodiments herein may be carried out without one or more of the details; alternatively, another method, component, device, option, etc., may be adopted. Under other conditions, no detail of a known structure, method, device, implementation, material or operation may be shown or described to avoid obscuring aspects of embodiments herein.

A block diagram shown in the accompanying drawings may be a functional entity which may not necessarily correspond to a physically or logically independent entity. Such a functional entity may be implemented in form of software, in one or more hardware modules or integrated circuits, or in different networks and/or processor devices and/or microcontroller devices.

FIG. 1 is a diagram of a structure of an antenna module according to an example. As shown in FIG. 1, the antenna module may include a first radiator, a second radiator, a first feed point, and a second feed point.

The first radiator 101 has an opening 102 inside the perimeter of the first radiator 101.

The second radiator 103 is located inside the opening 102. The second radiator is spaced apart from the first radiator 101, The first feed point 104 is located on the first radiator 101. The first feed point may be configured for transmitting a wireless signal in a first frequency band.

The second feed point 105 is located on the second radiator 103. The second feed point may be configured for transmitting a wireless signal in a second frequency band.

The second frequency band differs from the first frequency band.

According to an embodiment herein, the antenna module may implement inter-equipment communication. The antenna module may be widely applied to UE such as a smart phone, a smart watch, etc.

Each of the first radiator and the second radiator may be a conductor for transmitting or receiving a wireless signal. Each of the first radiator and the second radiator may be a radiator formed by a Flexible Printed Circuit (FPC), Laser Direct Structuring (LDS), direct printing, etc.

According to an embodiment herein, the second radiator may be located inside the opening of the first radiator. The second radiator may be spaced apart from the first radiator. That is, isolation between the first radiator and the second radiator may be implemented through spatial isolation.

For example, the size of the opening of the first radiator may be greater than the size of the second radiator. Therefore, when the second radiator may be located inside the opening, a gap or spacing may be formed between the second radiator and the first radiator. According to an embodiment herein, separation between highly isolated antenna modules may be greater than separation between less isolated antenna modules.

According to an embodiment herein, an area of the opening may be inversely related to a frequency of a wireless signal transmitted or received by the second radiator.

Note that the higher the frequency of the wireless signal transmitted or received by the second radiator is, the smaller the second radiator, and therefore the smaller the area of the opening. According to an embodiment herein, when the second radiator is rectangular, the opening may also be rectangular. When the second radiator is L-shaped, the opening may also be L-shaped. In this way, the shape of the second radiator may match the shape of the opening, allowing the second radiator to be better embedded in the first radiator.

According to an embodiment herein, the first radiator may enclose the second radiator. The first radiator and the second radiator may be located on one plane.

According to an embodiment herein, the opening may be provided on the edge of the first radiator. The first radiator may enclose part of the second radiator. According to an embodiment herein, the second radiator may be embedded at a center location of the opening through injection molding or printing.

The printing process may include direct printing or LDS. The second radiator may be embedded in the opening by LDS at the center location of the opening. The second radiator may be embedded in the opening by direct printing at the center location of the opening.

According to an embodiment herein, the first radiator and the second radiator may be located on one plane of one carrier. For example, when the antenna module is provided on a smart phone, both the first radiator and the second radiator may be located on a Printed Circuit Board (PCB), on an inner surface of a side frame, on an inner surface of a back cover, etc., which is not limited herein.

The first feed point and the second feed point may be two distinct separate feed points capable of feeding the first radiator and the second radiator independently.

Note that the first feed point, as well as the second feed point, may transmit a first electric signal generated by a radio frequency front end of the antenna module respectively to the first radiator and the second radiator. Accordingly, each of the first radiator and the second radiator may radiate a wireless signal excited by the first electric signal. Alternatively, a radiator may convert a received wireless signal into a second electric signal. Then, the first feed point, as well as the second feed point, may transmit the second electric signal to a respective radio frequency front end, implementing subsequent processing such as wireless signal reception, signal decoding, etc.

According to an embodiment herein, the first radiator, combined with the first feed point, may transmit the wireless signal of the first frequency band.

Exemplarily, the first frequency band may be a frequency band corresponding to 2G, a frequency band corresponding to 3G, a frequency band corresponding to 4G, etc., which is not limited herein.

According to an embodiment herein, the second radiator, combined with the second feed point, may transmit the wireless signal of the second frequency band.

Exemplarily, the second frequency band may include a frequency band of 2515 MHz to 2675 MHz corresponding to N41, a frequency band of 3400 MHz to 3600 MHz corresponding to N78, a frequency band of 4800 MHz to 4900 MHz corresponding to N79, etc., which is not limited herein.

Figure 2:
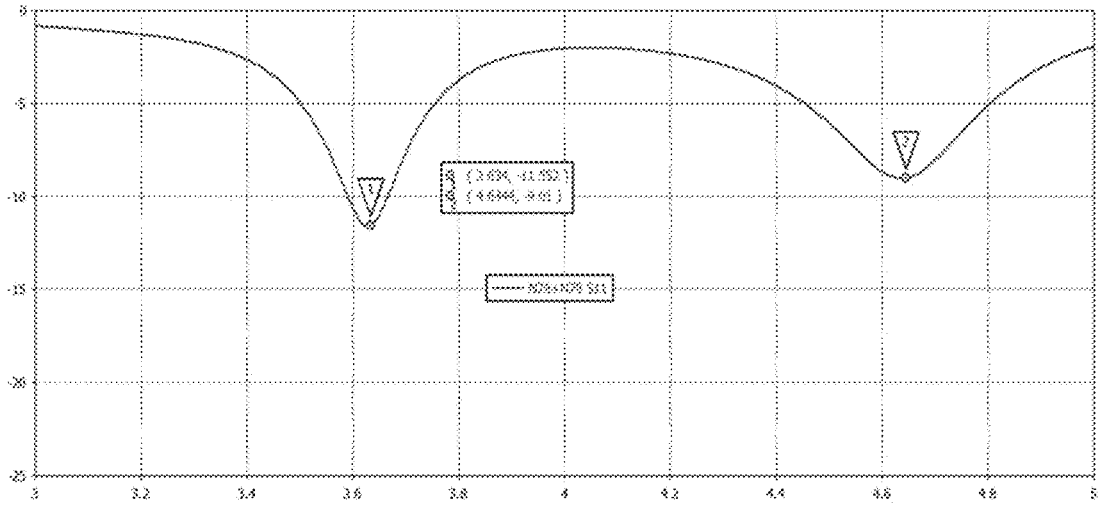
FIG. 2 is a diagram of a return loss of a second radiator according to an example.

Exemplarily, as shown in FIG. 2, abscissas are frequencies in units of GHz. Ordinates are return losses in units of dB. A return loss of the second radiator at a frequency 3.634 GHz may be −11.552 dB. A return loss of the second radiator at a frequency 4.6444 GHz may be −9.01 dB. In this way, by feeding through just the second radiator, the second radiator may receive and/or transmit a wireless signal of frequency bands corresponding to N78 and N79 with a reduced return loss, improving receiving and transmitting performance of the second radiator.

Figure 3:
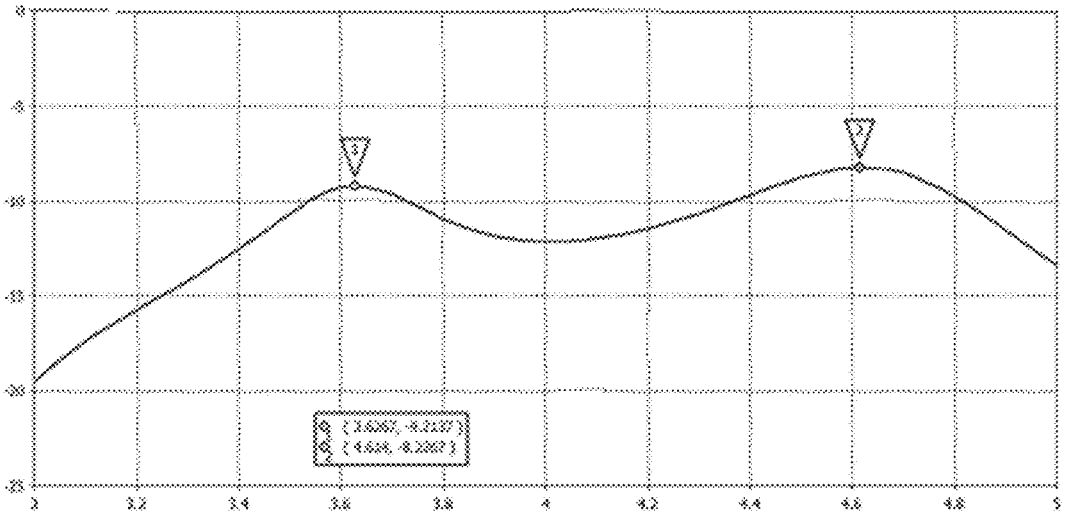
FIG. 3 is a diagram of efficiency of radiation of a second radiator according to an example.

Exemplarily, FIG. 3 is a diagram of antenna efficiency of an antenna module in receiving and/or transmitting a wireless signal of a second frequency band. As shown in FIG. 3, abscissas are frequencies in units of GHz. Ordinates are efficiencies of radiation in units of dB. Efficiency of radiation of the second radiator at a frequency 3.6267 GHz may be −9.2137 dB. Efficiency of radiation of the second radiator at a frequency 4.614 GHz may be −8.2267 dB. Therefore, the second radiator may receive and/or transmit a wireless signal of the second frequency band with satisfactory performance.

Understandably, the second radiator may be located inside the opening of the first radiator. The second radiator may receive and/or transmit a wireless signal of a frequency band differing from a frequency band of a wireless signal received and/or transmitted by the first radiator. Therefore, the antenna module herein may receive and/or transmit both a wireless signal of the first frequency band and a wireless signal of the second frequency band. Accordingly, the antenna module may receive and/or transmit a wireless signal of an expanded frequency band. Furthermore, herein, the second radiator may be located inside the opening of the first radiator. The second radiator occupies no additional internal space of UE. Accordingly, overall space of UE occupied by the antenna module is reduced, improving utilization of UE space.

Figure 4:
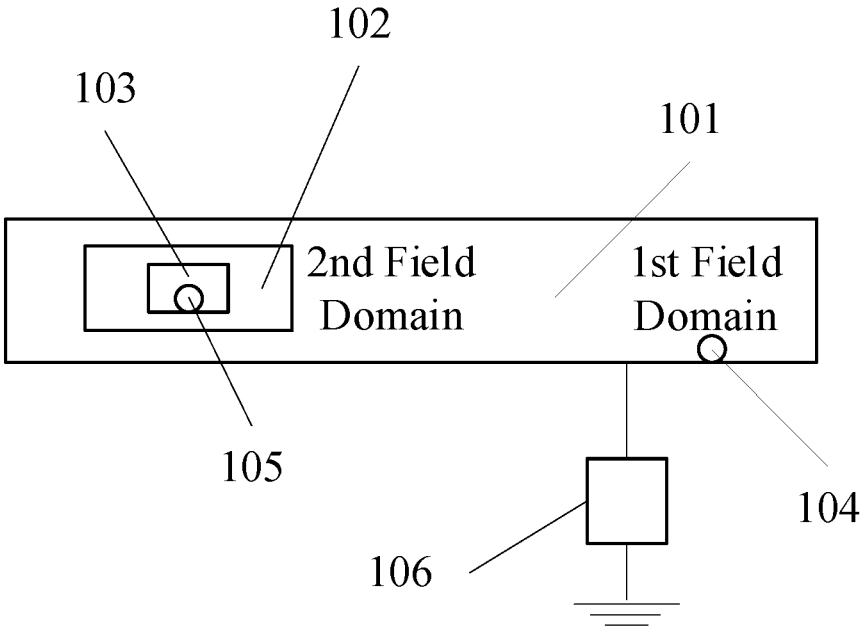
FIG. 4 is a diagram of an antenna module according to an example.

According to an embodiment herein, as shown in FIG. 4, the first feed point may be provided at a first end of the first radiator. The antenna module may further include a switch 106.

The switch 106 may be connected to the first radiator 101 at a connection point. A distance between the connection point and the first end of the first radiator may be less than a distance between the connection point and a second end of the first radiator. The second end may be an end of the first radiator opposite the first end.

The switch may include at least one switch component. The first radiator may receive and/or transmit a wireless signal of different frequency bands corresponding respectively to different switch states of the at least one switch component.

In other words, herein, the switch may be provided close to the first radiator. The switch may match the first radiator to allow the first radiator to receive and/or transmit a wireless signal of different frequency bands.

According to an embodiment herein, the switch may have two connection ends, one connected to the first radiator, and the other grounded. Different switch states of the switch component may result in different impedances of combination of the switch and the first radiator.

Note that a switch state of a switch component may include an ON state and an OFF state. When the switch component is in the ON state, the combination of the switch and the first radiator may have first impedance. When the switch component is in the OFF state, the combination of the switch and the first radiator may have second impedance different from the first impedance. Based on the first impedance and the second impedance, the first radiator may receive and/or transmit a wireless signal of different frequency bands.

For example, in addition to communication frequency bands corresponding to 2G and 3G, the first radiator may also receive and/or transmit frequency bands corresponding to N78 and N79 in 5G frequency bands, which is not limited herein.

According to an embodiment herein, the switch component may include a component consisting of a Metal-Oxide-Semiconductor (MOS) transistor, a triode, etc. A switch component may include a control end and two connection ends. The control end may be configured to receive a control signal and control a switch state of the switch component based on the control signal. The control signal may be sent to the control end by a radio frequency chip, a controller, etc. The control signal may include, but is not limited to, an electrical level output to the control end. When the control end is at a low level, the switch component may be controlled to be in an ON state. When the control end is at a high level, the switch component may be controlled to be in an OFF state.

Figure 5:
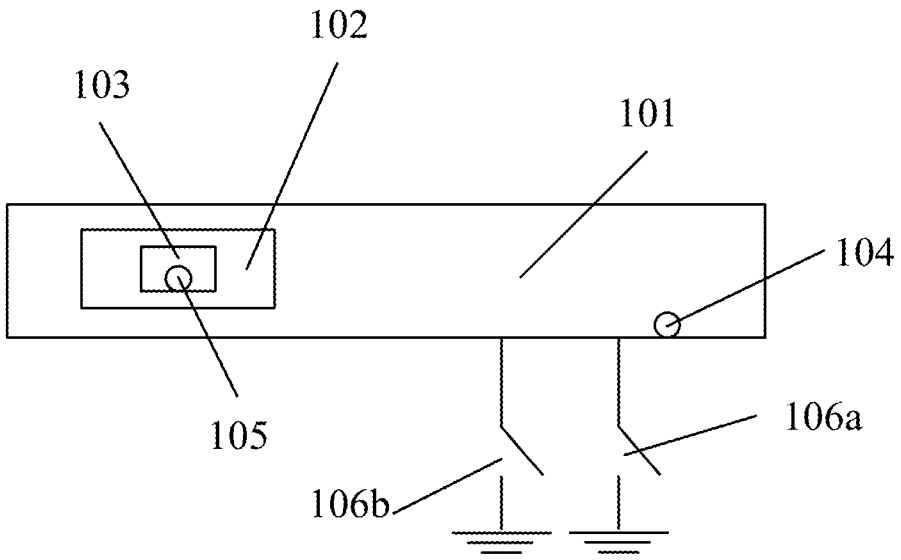
FIG. 5 is a diagram of an antenna module according to an example.

According to an embodiment herein, as shown in FIG. 5, the switch may include a first switch component 106*a* and a second switch component 106*b* provided in parallel with the first switch component 106*a*.

When both the first switch component 106*a* and the second switch component 106*b* are in an ON state, the first radiator may receive and/or transmit the wireless signal of the second frequency band.

In other words, herein, the antenna module may be expanded to receive and/or transmit the second frequency band not only by embedding the second radiator in the first radiator, but also by changing the switch state of the first switch component and the switch state of the second switch component. Therefore, herein, both radiators may receive and/or transmit the second frequency band, improving performance of the antenna module in receiving and transmitting the second frequency band.

According to an embodiment herein, when both the first switch component and the second switch component are in an OFF state, the first radiator may receive and/or transmit a wireless signal in a first sub-frequency band. When the first switch component is in an OFF state and the second switch component is in an ON state, the first radiator may receive and/or transmit a wireless signal in a second sub-frequency band. When the first switch component is in an ON state and the second switch component is in an OFF state, the first radiator may receive and/or transmit a wireless signal in a third sub-frequency band.

The first sub-frequency band, the second sub-frequency band, and the third sub-frequency band may all be sub-frequency bands within the first frequency band. A center frequency of the first sub-frequency band may be less than a center frequency of the second sub-frequency band. The center frequency of the second sub-frequency band may be less than a center frequency of the third sub-frequency band.

According to an embodiment herein, both the first switch component and the second switch component may include a MOS transistor, a triode, etc. When both the first switch component and the second switch component are in an OFF state, both connection ends of the first switch component as well as the second switch component may be disconnected and be in a disconnected state. When both the first switch component and the second switch component are in an ON state, both connection ends of the switch components may be in a connected state.

Figure 6:
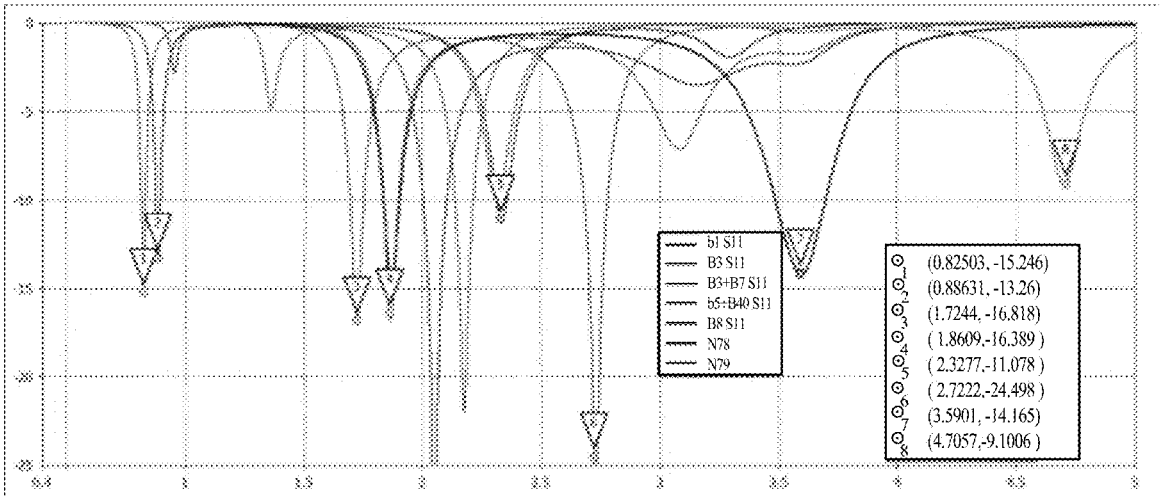
FIG. 6 is a diagram of a return loss of a first radiator according to an example.

Exemplarily, as shown in FIG. 6, abscissas are frequencies in units of GHz. Ordinates are return losses in units of dB. It may be seen from FIG. 6 that a return loss of the first radiator at a frequency 0.82503 GHz may be −15.246 dB. A return loss of the first radiator at a frequency 0.88631 GHz may be −13.26 dB. A return loss of the first radiator at a frequency 1.7244 GHz may be −16.818 dB. A return loss of the first radiator at a frequency 1.8609 GHz may be −16.389 dB. A return loss of the first radiator at a frequency 2.3277 GHz may be −11.078 dB. A return loss of the first radiator at a frequency 2.7222 GHz may be −24.498 dB. A return loss of the first radiator at a frequency 3.5901 GHz may be −14.165 dB. A return loss of the first radiator at a frequency 4.7057 GHz may be −9.1006 dB. Therefore, switching-on and switching-off of different switch components may allow the first radiator to receive and/or transmit a wireless signal of different frequency bands, with satisfactory return losses.

Figure 7:
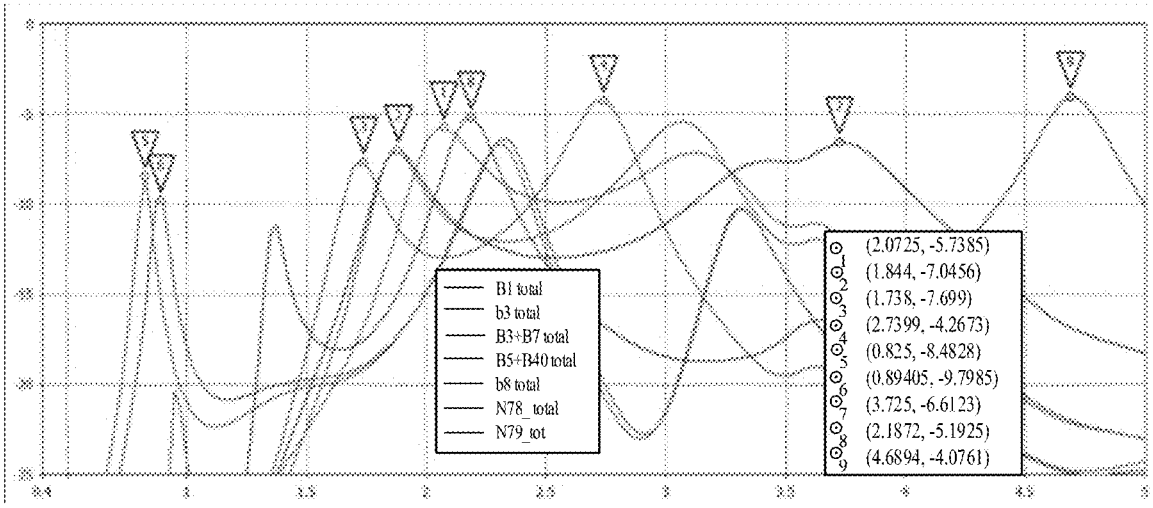
FIG. 7 is a diagram of efficiency of radiation of a first radiator according to an example.

Exemplarily, as shown in FIG. 7, abscissas are frequencies in units of GHz. Ordinates are efficiencies of radiation in units of dB. It may be seen from FIG. 7 that efficiency of radiation of the first radiator at a frequency 2.0725 GHz may be −5.7385 dB. Efficiency of radiation of the first radiator at a frequency 1.8844 GHz may be −7.0456 dB. Efficiency of radiation of the first radiator at a frequency 1.738 GHz may be −7.699 dB. Efficiency of radiation of the first radiator at a frequency 2.7399 GHz may be −4.2673 dB. Efficiency of radiation of the first radiator at a frequency 0.825 GHz may be −8.4828 dB. Efficiency of radiation of the first radiator at a frequency 0.89405 GHz may be −9.7985 dB. Efficiency of radiation of the first radiator at a frequency 3.725 GHz may be −6.6123 dB. Efficiency of radiation of the first radiator at a frequency 2.1872 GHz may be −5.1925 dB. Efficiency of radiation of the first radiator at a frequency 4.6894 GHz may be −4.0761 dB. Therefore, the first radiator may receive and/or transmit a wireless signal of different frequency bands with satisfactory efficiency of radiation.

According to an embodiment herein, as shown in FIG. 4, the connection point of the switch and the first radiator may divide the first radiator into a first field domain and a second field domain. Radiation energy in the first field domain may be greater than radiation energy in the second field domain.

The first feed point may be located inside the first field domain.

The opening may be located inside the second field domain, away from the first field domain.

According to an embodiment herein, the first radiator may include a first end and a second end. The area between the connection point and the first end may be the first field domain. The area between the connection point and the second end may be the second field domain.

Note that distribution of energy of a wireless signal radiated by the first radiator may differ. Moreover, radiation energy in the first radiator gradually decrease lengthwise along the first radiator. Therefore, the opening may be provided inside the second field domain, away from the first field domain. That is, the opening may be provided where radiation energy in the first radiator is small. Accordingly, the first radiator and the second radiator may be more isolated from each other, reducing interference between the two radiators.

The opening may be provided away from the first field domain as follows. The opening may be provided on an edge of the second field domain away from the first field domain, thereby minimizing interference to the second radiator by the first radiator, improving receiving and transmitting performance of the antenna module.

According to an embodiment herein, the antenna module may further include a first radio frequency front end, a second radio frequency front end, a first impedance matched network, and a second impedance matched network.

The second radio frequency front end may differ from the first radio frequency front end.

The first impedance matched network may be connected between the first feed point and the first radio frequency front end. The first impedance matched network may share, with the first feed point and the first radio frequency front end, a common impedance within a preset range.

The second impedance matched network may be independent of the first impedance matched network. The second impedance matched network may be connected between the second feed point and the second radio frequency front end. The second impedance matched network may share, with the second feed point and the second radio frequency front end, a common impedance within the preset range.

In this way, by, as much energy generated by the first radio frequency front end as possible may be radiated through the first radiator and the first impedance matched network, thereby reducing transmission damage, improving efficiency in receiving and/or transmitting the first frequency band. As much energy generated by the second radio frequency front end as possible may be radiated through the second radiator and the second impedance matched network, thereby reducing transmission damage, improving efficiency in receiving and/or transmitting the second frequency band.

Furthermore, the first impedance matched network and the second impedance matched network may be independent of each other. Accordingly, the first radiator and the second radiator may be tuned separately. Accordingly, impedance may be tuned flexibly as adapted to a scene.

Each of the first impedance matched network and the second impedance matched network may consist of a switch, an inductor, and/or a capacitor. For example, the first impedance matched network may consist of a switch and an inductor. The second impedance matched network may consist of a switch and a capacitor.

According to an embodiment herein, output impedance of both the first radio frequency front end and the second radio frequency front end may be 50 ohms. Then, matching may be performed on both the first impedance matched network and the second impedance matched network using a Smith chart. Impedance of the first frequency band may be matched to vicinity of a 50-ohm area in the Smith chart. Impedance of the second frequency band may be matched to vicinity of the 50-ohm area in the Smith chart. Accordingly, as much energy generated by both the first radio frequency front end and the second radio frequency front end as possible may be radiated through the respective radiators.

Note that a structure of the first impedance matched network as well as a structure of the second impedance matched network may be varied, as long as impedance of a first frequency is matched to vicinity of the 50-ohm area in the Smith chart.

An aforementioned radio frequency front end may provide a first signal to a radiator, and may receive a second signal through a feed point. The radio frequency front end may include a first amplifier, an antenna switch, a filter component, a duplexer, and a second amplifier. The first amplifier may be adapted to amplifying an electric signal on a signal output channel. The antenna switch may be adapted to switch between receiving an electric signal and transmitting an electric signal, as well as switch between different frequency bands of an antenna. The filter may be adapted to allow a signal of a specific frequency band to pass while filtering out a signal beyond the specific frequency band. The duplexer may be adapted to isolating a transmitted electric signal from a received electric signal, allowing the antenna to simultaneously receiving a wireless signal and transmitting a wireless signal properly. The second amplifier may be adapted to amplifying an electric signal on a signal receiving channel. In this way, reception as well as transmission of an electric signal may be implemented using the radio frequency front end, improving performance of the radiator in receiving and/or transmitting a wireless signal.

Exemplarily, the preset range may be provided as needed. For example, a preset range of 90 ohms to 110 ohms may be provided.

According to an embodiment herein, the antenna module may further include an isolating layer.

The isolating layer may be located in between the first radiator and the second radiator. The isolating layer may serve to isolate the first radiator from the second radiator.

In other words, by adding an isolating layer between the first radiator and the second radiator, the first radiator may become more isolated from the second radiator, thereby reducing interference between the first radiator and the second radiator.

The isolating layer may be made of non-conductive material, such as plastic, foam, fiber, etc.

Figure 8:
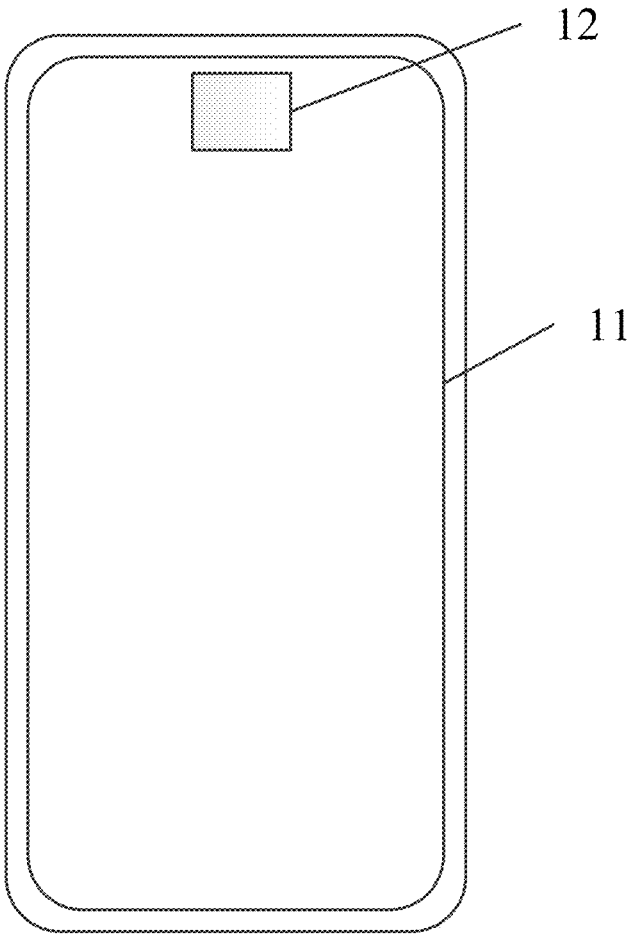
FIG. 8 is a diagram of UE according to an example.

According to an embodiment herein, User Equipment (UE) may be further provided. As shown in FIG. 8, the UE may further include a housing 11 and an antenna module herein.

The antenna module 12 may be located inside the housing 11. The antenna module may be adapted to receiving and/or transmitting wireless signals of different frequency bands.

According to an embodiment herein, the UE may be wearable electronic equipment, mobile UE, etc. The mobile UE may include a mobile phone, a notebook computer, a tablet computer, etc. The wearable electronic equipment may include a smart watch, etc., which is not limited herein.

Understandably, the second radiator may be located inside the opening of the first radiator. The second radiator may receive and/or transmit a wireless signal of a frequency band differing from a frequency band of a wireless signal received and/or transmitted by the first radiator. Therefore, the UE herein may receive and/or transmit both a wireless signal of the first frequency band and a wireless signal of the second frequency band. Accordingly, the UE may receive and/or transmit a wireless signal of an expanded frequency band. Furthermore, herein, the second radiator may be located inside the opening of the first radiator. The second radiator occupies no additional internal space of the UE. Accordingly, overall space of the UE occupied by the antenna module is reduced, improving utilization of UE space.

According to an embodiment herein, the housing may include a back cover.

An inner surface of the back cover may be provided with a groove.

The antenna module may be located inside the groove.

In other words, the antenna module may be provided inside the groove of the inner surface of the back cover. Accordingly, on one hand, the antenna module may be located away from a device that may generate electromagnetic interference in the UE, improving environment the antenna module is in. On the other hand, the antenna module does not have to occupy additional internal space of the UE, improving utilization of UE space.

The back cover may be made of plastic, glass, or composite plastic and glass material.

According to an embodiment herein, the housing may further include a side frame and a middle frame located in an area surrounded by the side frame.

The antenna module may be located on an inner surface of the side frame, or on the middle frame.

The side frame and the middle frame may be made of non-conductive material. The non-conductive material may include, but is not limited to, various plastics.

According to an embodiment herein, the UE may further include a PCB.

The PCB may include a grounding layer. The grounding layer may surround the edge of the PCB.

Both the first radiator and the second radiator may be connected respectively to the grounding layer.

The first radiator and the second radiator may be connected respectively to the grounding layer via an antenna elastic piece, an antenna thimble, welding, etc., which is not limited herein.

Note that a term such as "first", "second", "third", etc., used herein is but for expression and differentiation, without any further specific meanings.

Figure 9:
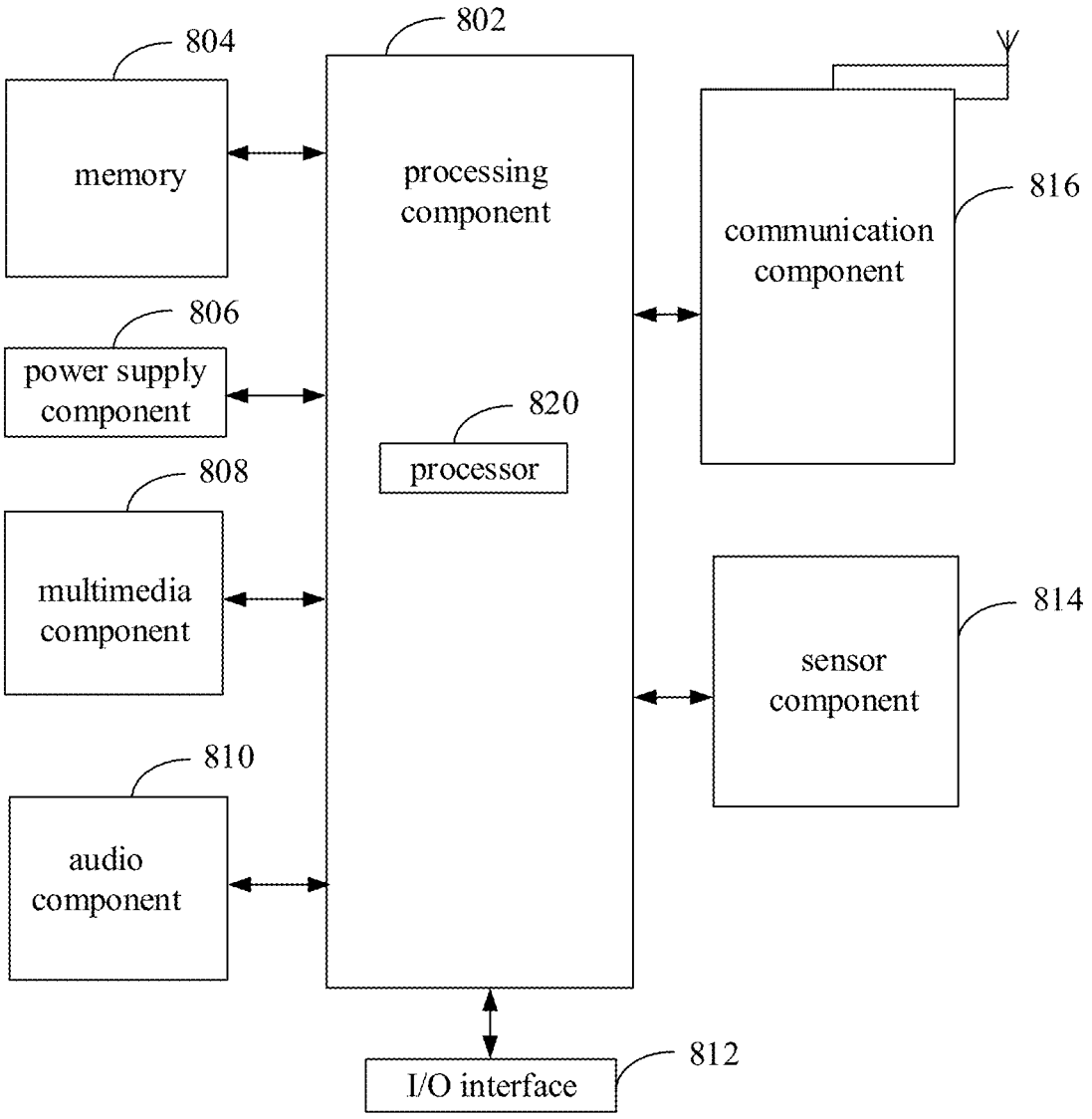
FIG. 9 is a block diagram of UE according to an example.

FIG. 9 is a block diagram of UE according to an example. For example, the UE may be UE such as a mobile phone, a computer, a digital broadcast terminal, messaging equipment, a gaming console, tablet equipment, medical equipment, exercise equipment, a personal digital assistant, etc.

Referring to FIG. 9, the UE may include at least one of a processing component 802, memory 804, a power supply component 806, a multimedia component 808, an audio component 810, an Input/Output (I/O) interface 812, a sensor component 814, or a communication component 816.

The processing component 802 may generally control an overall operation of the UE, such as operations associated with display, a telephone call, data communication, a camera operation, a recording operation, etc. The processing component 802 may include one or more processors 820 to execute instructions so as to complete all or a part of an aforementioned method. In addition, the processing component 802 may include one or more modules to facilitate interaction between the processing component 802 and other components. For example, the processing component 802 may include a multimedia portion to facilitate interaction between the multimedia component 808 and the processing component 802.

The memory 804 may be adapted to storing various types of data to support the operation at the UE. Examples of such data may include instructions of any application or method adapted to operating on the UE, contact data, phonebook data, messages, pictures, videos, etc. The memory 804 may be implemented by any type of transitory or non-transitory storage equipment or a combination thereof, such as Static Random Access Memory (SRAM), Electrically Erasable Programmable Read-Only Memory (EEPROM), Erasable Programmable Read-Only Memory (EPROM), Programmable Read-Only Memory (PROM), Read-Only Memory (ROM), magnetic memory, flash memory, a magnetic disk, a compact disk, etc.

The power supply component 806 may supply electric power to various components of the UE. The power supply component 806 may include a power management system, one or more power sources, and other components related to generating, managing, and distributing electricity for the UE.

The multimedia component 808 may include a screen that provides an output interface between the UE and a user. The screen may include a Liquid Crystal Display (LCD), a Touch Panel (TP), etc. If the screen may include a TP, the screen may be implemented as a touch screen to receive a signal input by a user. The TP may include one or more touch sensors for sensing touch, slide, and gestures on the TP. The one or more touch sensors not only may sense the boundary of a touch or slide move, but also detect the duration and pressure related to the touch or slide move. The multimedia component 808 may include at least one of a front camera or a rear camera. When the UE is in an operation mode such as a photographing mode or a video mode, at least one of the front camera or the rear camera may receive external multimedia data. Each of the front camera or the rear camera may be a fixed optical lens system or may have a focal length and be capable of optical zooming.

The audio component 810 may be adapted to outputting and/or inputting an audio signal. For example, the audio component 810 may include a microphone (MIC). When the UE is in an operation mode such as a call mode, a recording mode, a voice recognition mode, etc., the MIC may be adapted to receiving an external audio signal. The received audio signal may be further stored in the memory 804 or may be sent via the communication component 816. The audio component 810 may further include a loudspeaker adapted to outputting the audio signal.

The I/O interface 812 may provide an interface between the processing component 802 and a peripheral interface portion. Such a peripheral interface portion may be a keypad, a click wheel, a button, etc. Such a button may include but is not limited to at least one of a homepage button, a volume button, a start button, or a lock button.

The sensor component 814 may include one or more sensors for assessing various states of the UE. For example, the sensor component 814 may detect an on/off state of the UE and relative location of components such as the display and the keypad of the UE. The sensor component 814 may further detect a change in the location of the UE or of a component of the UE, whether there is contact between the UE and a user, the orientation or acceleration/deceleration of the UE, a change in the temperature of the UE, etc. The sensor component 814 may include a proximity sensor adapted to detecting existence of a nearby object without physical contact. The sensor component 814 may further include an optical sensor such as a Complementary Metal-Oxide-Semiconductor (CMOS) or a Charge-Coupled-Device (CCD) image sensor used in an imaging application. The sensor component 814 may further include an acceleration sensor, a gyroscope sensor, a magnetic sensor, a pressure sensor, a temperature sensor, etc.

The communication component 816 may be adapted to facilitating wired or wireless communication between the UE and other equipment. The UE may access a wireless network based on a communication standard such as Wi-Fi, 2G, 3G . . . , or a combination thereof. The communication component 816 may broadcast related information or receive a broadcast signal from an external broadcast management system via a broadcast channel. The communication component 816 may include a Near Field Communication (NFC) module for short-range communication. For example, the NFC module may be based on technology such as Radio Frequency Identification (RFID), Infrared Data Association (IrDA), Ultra-Wideband (UWB) technology, Bluetooth (BT), etc.

The UE may be implemented by one or more electronic components such as an Application Specific Integrated Circuit (ASIC), a Digital Signal Processor (DSP), a Digital Signal Processing Device (DSPD), a Programmable Logic Device (PLD), a Field Programmable Gate Array (FPGA), a controller, a microcontroller, a microprocessor, etc., to implement the method.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "component," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Other embodiments according to the subject disclosure will be apparent to one skilled in the art after he/she has considered the subject disclosure and practiced the invention disclosed herein. The subject application is intended to cover any variation, use, or adaptation of the subject disclosure following the general principle of the subject disclosure and including such departures from the subject disclosure as come within knowledge or customary practice in the art. The subject disclosure and its embodiments are intended to be exemplary only, with a true scope and spirit of the subject disclosure being indicated by the appended claims.

The subject disclosure is not limited to the exact construction that has been described above and illustrated in the accompanying drawings. Various modifications and changes can be made without departing from the scope of the subject disclosure. It is intended that the scope of the subject disclosure be limited only by the appended claims.

What is claimed is:

1. An antenna module, comprising:

a first radiator having an opening;

a second radiator located inside the opening, the second radiator being spaced apart from the first radiator;

a first feed point located on the first radiator, the first feed point being configured for transmitting a wireless signal in a first frequency band; and a second feed point located on the second radiator, the second feed point being configured for transmitting a wireless signal in a second frequency band, wherein the second frequency band differs from the first frequency band, wherein the first feed point is provided at a first end of the first radiator, wherein the antenna module further comprises a switch, wherein the switch is connected to the first radiator at a connection point, wherein a first distance between the connection point and the first end of the first radiator is less than a second distance between the connection point and a second end of the first radiator, wherein the second end is an end of the first radiator opposite the first end, wherein the switch comprises at least one switch component, wherein the first radiator receives or transmits a wireless signal of different frequency bands corresponding respectively to different switch states of the at least one switch component, wherein the switch comprises a first switch component and a second switch component provided in parallel with the first switch component, wherein when both the first switch component and the second switch component are in an ON state, the first radiator receives or transmits the wireless signal of the second frequency band.

2. The antenna module of claim 1, wherein the connection point of the switch and the first radiator divides the first radiator into a first field domain and a second field domain, wherein radiation energy in the first field domain is greater than radiation energy in the second field domain, wherein the first feed point is located inside the first field domain, wherein the opening is located inside the second field domain, away from the first field domain.

3. The antenna module of claim 1, further comprising:

a first radio frequency front end;

a second radio frequency front end differing from the first radio frequency front end;

a first impedance matched network connected between the first feed point and the first radio frequency front end, the first impedance matched network sharing, with the first feed point and the first radio frequency front end, a common impedance within a preset range; and a second impedance matched network independent of the first impedance matched network, the second impedance matched network being connected between the second feed point and the second radio frequency front end, the second impedance matched network sharing, with the second feed point and the second radio frequency front end, a common impedance within the preset range.

4. The antenna module of claim 1, wherein the first radiator surrounds the second radiator, the first radiator and the second radiator being located on one plane.

5. The antenna module of claim 1, wherein an area of the opening is inversely related to a frequency of a wireless signal transmitted or received by the second radiator.

6. The antenna module of claim 1, further comprising an isolating layer, the isolating layer being located in between the first radiator and the second radiator, the isolating layer serving to isolate the first radiator from the second radiator.

7. The antenna module of claim 1, wherein the second radiator is embedded at a center location of the opening through injection molding or printing.

8. User Equipment (UE), comprising a housing and the antenna module of claim 1, the antenna module being located inside the housing, the antenna module being adapted to receiving or transmitting wireless signals of different frequency bands.

9. The UE of claim 8, wherein the housing comprises a back cover, an inner surface of the back cover being provided with a groove, the antenna module being located inside the groove.

10. The UE of claim 8, wherein the housing further comprises a side frame and a middle frame located in an area surrounded by the side frame, the antenna module being located on an inner surface of the side frame, or on the middle frame.

* * * * *